US007999470B2

(12) United States Patent
Snijkers-Hendrickx et al.

(10) Patent No.: US 7,999,470 B2
(45) Date of Patent: Aug. 16, 2011

(54) LOW-PRESSURE MERCURY VAPOR DISCHARGE LAMP

(75) Inventors: Ingrid Jozef Maria Snijkers-Hendrickx, Eindhoven (NL); Engelbertus Cornelius Petrus Maria Vossen, Eindhoven (NL); Esther De Beer, Eindhoven (NL); Bennie Josephus De Maagt, Eindhoven (NL); Claudio Boffito, Nerviano (IT); Alessio Corazza, Como (IT)

(73) Assignee: Koninklijke Philips Electronics N.V., Eindhoven (NL)

( * ) Notice: Subject to any disclaimer, the term of this patent is extended or adjusted under 35 U.S.C. 154(b) by 580 days.

(21) Appl. No.: 11/721,818

(22) PCT Filed: Dec. 16, 2005

(86) PCT No.: PCT/IB2005/054288

§ 371 (c)(1),
(2), (4) Date: Jun. 15, 2007

(87) PCT Pub. No.: WO2006/067718

PCT Pub. Date: Jun. 29, 2006

(65) Prior Publication Data

US 2009/0267514 A1 Oct. 29, 2009

(30) Foreign Application Priority Data

Dec. 21, 2004 (EP) ..... 04106792

(51) Int. Cl.

| | |
|---|---|
| ***H01J 61/12*** | (2006.01) |
| ***H01J 61/24*** | (2006.01) |
| ***H01J 61/28*** | (2006.01) |
| ***H01J 61/30*** | (2006.01) |
| ***H01J 61/20*** | (2006.01) |

(52) U.S. Cl. ..... 313/577; 313/552; 313/559; 313/561; 313/562; 313/634; 313/642

(58) Field of Classification Search ..... 313/577, 313/633, 634, 637, 546, 547, 549–552, 556, 313/563, 564, 566, 568, 572–576
See application file for complete search history.

(56) References Cited

U.S. PATENT DOCUMENTS

| | | | | |
|---|---|---|---|---|
| 3,794,403 | A * | 2/1974 | Ridders et al. | 445/73 |
| 4,105,910 | A * | 8/1978 | Evans | 313/490 |
| 4,163,666 | A * | 8/1979 | Shaltiel et al. | 423/644 |
| 4,260,934 | A * | 4/1981 | Kuus et al. | 315/326 |
| 4,374,340 | A * | 2/1983 | Bouwknegt et al. | 313/608 |
| 4,544,997 | A | 10/1985 | Seuter et al. | |
| 5,514,932 | A | 5/1996 | Willibrordus et al. | |
| 5,585,693 | A * | 12/1996 | Shaffer | 313/489 |
| 5,811,154 | A | 9/1998 | Ronda et al. | |
| 6,100,627 | A * | 8/2000 | Carretti et al. | 313/309 |
| 6,443,789 | B2 | 9/2002 | Tominetti et al. | |
| 6,538,372 | B2 | 3/2003 | Vose et al. | |
| 6,589,312 | B1 * | 7/2003 | Snow et al. | 75/255 |
| 2004/0012333 | A1 | 1/2004 | Blohm et al. | |
| 2005/0017644 | A1 * | 1/2005 | Ono et al. | 313/633 |

FOREIGN PATENT DOCUMENTS

EP 0755173 A2 1/1997

* cited by examiner

*Primary Examiner* — Nimeshkumar D Patel
*Assistant Examiner* — Steven Horikoshi

(57) ABSTRACT

A low-pressure mercury vapor discharge lamp has a light-transmitting discharge vessel enclosing, in a gastight manner, a discharge space provided with a filling of mercury and a rare gas. The discharge vessel includes electrode(s) for maintaining a discharge in the discharge space. The discharge vessel further includes a dispenser for controllably dispensing hydrogen into the discharge space during lamp operation. The hydrogen gas pressure during lamp operation is in the range between $10^{-3}$ Pa and 10 Pa.

13 Claims, 6 Drawing Sheets

LOW-PRESSURE MERCURY VAPOR DISCHARGE LAMP

The invention relates to a low-pressure mercury vapor discharge lamp comprising a light-transmitting discharge vessel, the discharge vessel enclosing, in a gastight manner, a discharge space provided with a filling of mercury and a rare gas, the discharge vessel comprising discharge means for maintaining a discharge in the discharge space.

The invention also relates to a method of manufacturing a low-pressure mercury vapor discharge lamp.

In mercury vapor discharge lamps, mercury constitutes the primary component for the (efficient) generation of ultraviolet (UV) light. A luminescent layer comprising a luminescent material (for example, a fluorescent powder) may be present on an inner wall of the discharge vessel to convert UV to other wavelengths, for example, to UV-B and UV-A for tanning purposes (sun-panel lamps) or to visible radiation for general illumination purposes. Such discharge lamps are therefore also referred to as fluorescent lamps. The discharge vessel of low-pressure mercury vapor discharge lamps is usually tubular and circular in section and comprises both elongated and compact embodiments. Generally, the tubular discharge vessel of so-called compact fluorescent lamps comprises a collection of relatively short straight parts having a relatively small diameter, which straight parts are connected together by means of so-called bridge parts or so-called arc-shaped parts. Compact fluorescent lamps are usually provided with an (integrated) lamp cap. Alternatively, UV generated by the discharge may be directly used for disinfection purposes.

The means for maintaining a discharge in the discharge space, generally, comprise two electrodes disposed at either end of the low-pressure mercury vapor discharge lamp. In operation, a voltage is maintained between the electrodes, as a result of which a continuous discharge takes place and the mercury vapor emits the aforesaid UV light. The ends of the electrodes may be surrounded in a radial direction by a so-called electrode ring, because the electrodes regularly discharge small particles in use, which particles would land on an inner wall of the discharge vessel, a phenomenon also being known as "wall blackening". This is undesirable, since it leads to a local reduction of the light output, causing the lamp to exhibit an irregular light output, and, consequently, the particles are intercepted by the electrode ring. In an alternative embodiment the low-pressure mercury vapor discharge lamp comprises a so-called electrodeless low-pressure mercury vapor discharge lamp.

A low-pressure mercury vapor discharge lamp of the type described in the opening paragraph is known from U.S. Pat. No. 5,514,932. An inner surface of the discharge vessel facing the discharge space is provided with a protective layer of aluminum oxide particles which comprise a comparatively great proportional weight of larger particles with a median diameter of 0.25 to 0.80 μm and a comparatively small proportional weight of smaller aluminum oxide particles with a median diameter of 0.01 to 0.02 μm, which smaller particles are dispersed among the larger particles. The aluminum oxide layer has the function to reduce interaction between the mercury and the lamp glass. The known low-pressure mercury discharge lamp has a comparatively high light depreciation. A drawback of the known low-pressure mercury vapor discharge lamp is that the mercury consumption during life is still relatively high and consequently the maintenance is still relatively poor. As a result, in addition, still a relatively large amount of mercury is necessary for the known lamp in order to realize a sufficiently long service life. In the case of injudicious processing after the end of the service life, this is detrimental to the environment.

The invention has for its object to eliminate the above disadvantage wholly or partly. According to the invention, a low-pressure mercury vapor discharge lamp of the kind mentioned in the opening paragraph for this purpose comprises:

a light-transmitting discharge vessel, the discharge vessel enclosing, in a gastight manner, a discharge space provided with a filling of mercury and a rare gas, the discharge vessel comprising discharge means for maintaining a discharge in the discharge space, the discharge vessel comprising dispenser means for controllably dispensing hydrogen into the discharge space, the hydrogen gas pressure in the discharge vessel being in the range between $10^{-3}$ Pa and 10 Pa.

Surprisingly, experiments have shown that the presence of certain amounts of hydrogen in the discharge vessel during operation of the low-pressure mercury vapor discharge lamp considerably reduces the "mercury consumption" by parts in the discharge vessel of the low-pressure mercury vapor discharge lamp. As a result it is possible to refrain from taking the aforesaid measures of the prior art, i.e. providing a protective layer of aluminum oxide particles. If in the low-pressure mercury vapor discharge lamp according to the invention, the protective layer is employed the effect of the measure according to the invention would be enhanced.

In addition, experiments have shown that the hydrogen that is released from the dispenser means is, preferentially located on layers (deposited) on an inner wall of the discharge vessel. Such layers comprise, for example, fluorescent layers and/or a (translucent) layer for protecting the glass wall of the discharge vessel from attack by the discharge (e.g. the protective translucent layer as employed in the known low-pressure mercury vapor discharge lamp). Not wishing to be held to any particular theory, it appears that hydrogen is able to occupy active sites in the discharge vessel that would otherwise be free to react with mercury. The presence of hydrogen appears to hamper mercury to become bound to said parts in the discharge vessel. As a consequence, more mercury is available to contribute to the discharge during the lifespan of the low-pressure mercury vapor discharge lamp. The continuous presence of hydrogen during life of the low-pressure mercury vapor discharge lamp according to the invention makes it possible to dose less mercury in the discharge vessel during manufacturing of the low-pressure mercury vapor discharge lamp. This is advantageous because there is, stimulated by environmental considerations, a general endeavor to reduce the amount of mercury in discharge lamps. A low-pressure mercury vapor discharge lamp according to the invention with dispenser means for controllably dispensing hydrogen into the discharge space appears to create an atmosphere in the discharge vessel that reduces mercury consumption and as a consequence improves the maintenance of the discharge lamp.

The application of a hydrogen gas pressure in the discharge vessel during the life of the low-pressure mercury vapor discharge lamp has a positive effect on the glass, on any protective coating as well as on the luminescent layer.

It is known from U.S. Pat. No. 5,585,693 that relatively large quantities of hydrogen may cause an arc shutdown of a low-pressure mercury vapor discharge lamp. In said US patent hydrogen is released at the end of the life of the discharge lamp, the presence of hydrogen in the discharge vessel causing a rise in the voltage required to sustain a discharge well above that provided by instant start ballasts, causing the discharge lamp to go out passively (quenching of the lamp), without significant end heating or glass heating.

In the present invention relatively small amounts of hydrogen are controllably released during the life of the discharge lamp. The presence of relatively small amounts of hydrogen in the discharge vessel is sufficient to considerably reduce the effect of mercury consumption.

According to the invention, the hydrogen gas pressure is in the range between $10^{-3}$ Pa (=$10^{-5}$ mbar) and 10 Pa (=$10^{-1}$ mbar). For hydrogen gas pressures lower than $10^{-3}$ Pa, the effect of the presence of hydrogen in the discharge vessel is immeasurably small. For hydrogen gas pressures higher than 10 Pa, the lamp voltage rises to a level where maintaining or ignition of the discharge in the discharge vessel becomes a problem, i.e. the discharge quenches. Preferably, the hydrogen gas pressure is measured when the low-pressure mercury vapor discharge lamp is turned off for at least ten hours.

Preferably, the hydrogen gas pressure is in the range between $10^{-2}$ Pa (=$10^{-4}$ mbar) and 1 Pa (=$10^{-2}$ mbar). In this preferred range, the discharge can be readily ignited under all circumstances.

A variety of dispenser means are suitable for use in the discharge vessel of the low-pressure mercury vapor discharge lamp according to the invention. A preferred embodiment of the low-pressure mercury vapor discharge lamp according to the invention is characterized in that the dispenser means comprises a hydrogen-containing metal or metal alloy. Such alloys generally comprise an open (internal) structure with a high specific surface. Such alloys can relatively easily be loaded with relatively large quantities of hydrogen that can be controllably released as a function of time, the partial pressure being specific to the material as a function of the metal/hydrogen ratio and the temperature. In the description of this invention, the term "controllably dispensing" is to be interpreted as that hydrogen is (gradually) released from the dispenser means, by which maintenance of a constant hydrogen equilibrium pressure during life is obtained in the low-pressure mercury vapor discharge lamp.

Preferably, the hydrogen-containing metal or metal alloy is selected from the group formed by zirconium, yttrium, titanium and hafnium. Said metals or metal alloys are very suitable as controllable hydrogen dispenser means for the controllable release of hydrogen in the discharge vessel. The small amount of hydrogen in the lamp does not affect the lamp properties upon lifetime. In addition, the properties of the discharge lamp, i.e. lamp voltage, lamp current, etc., stay within acceptable ranges.

In a preferred embodiment of a low-pressure mercury vapor discharge lamp according to the invention, the dispenser means comprises a metal hydride selected from the group consisting of titanium, zirconium, hafnium, a titanium-zirconium compound, a titanium-hafnium compound and a zirconium-hafnium compound. A very suitable material is Ti—$H_2$ (titanium hydride). Other materials which can accumulate and can controllably release hydrogen are the ZrCo, ZrNi, or the ternary $ZrCo_{1-x}Ni_x$ or Zr—V—Fe alloy and also $LaNi_5$ and La $Ni_{5-x}Al_x$. In particular, a very suitable alloy is the Zr (46.5% by weight)—V (36.4% by weight)—Fe (17.1% by weight) alloy.

There are many ways in which the dispenser means can be provided in the discharge vessel of the low-pressure mercury vapor discharge lamp. A preferred embodiment of the low-pressure mercury vapor discharge lamp according to the invention is characterized in that the dispenser means is provided on an inner wall of the discharge vessel. Preferably, the dispenser means is applied as a paste on at least a part of the inner wall of the discharge vessel. It may be advantageous to apply the dispenser means in the vicinity of the discharge means in order to bring the dispenser to the desired operation temperature.

An alternative, preferred embodiment of the low-pressure mercury vapor discharge lamp according to the invention is characterized in that a capsule means arranged in the discharge vessel provides the dispenser means. Such a dispenser means is normally used to introduce mercury in the discharge vessel during manufacturing of the low-pressure mercury vapor discharge lamp. Preferably, the dispenser means is dosed in a (glass) capsule. After manufacturing the discharge lamp, the capsule is opened.

Yet a further alternative, preferred embodiment of the low-pressure mercury vapor discharge lamp according to the invention is characterized in that the discharge vessel comprises mutually opposed neck-shaped portions, current-supply conductors arranged in each of the neck-shaped portions extending to a pair of electrodes arranged in the discharge space, and wherein the dispenser means is provided on a supporting means carried by one of the current-supply conductors.

Preferably, the supporting means comprises an annular shaped body or a cup-shaped body or a wire shaped body. An annular shaped, cup shaped or wire shaped body has the advantage that no binder material is needed and that the dosing can be done in a controllable manner. In addition, such a body can be easily mounted during the manufacturing of the discharge lamp.

Yet a further alternative, preferred embodiment of the low-pressure mercury vapor discharge lamp according to the invention is characterized in that the discharge vessel comprises a further neck-shaped portion, at least one support wire being arranged in the further neck-shaped portion and extending in the discharge space, and wherein the dispenser means is provided on a supporting means carried by the least one support wire. The introduction of a further neck-shaped portion carrying the dispenser means is particularly useful in compact fluorescent lamps where "free" or "dummy" end portions are available.

An advantageous embodiment of the low-pressure mercury vapor discharge lamp according to the invention is characterized in that the discharge vessel comprises mutually opposed neck-shaped portions, current-supply conductors arranged in each of the neck-shaped portions extending to a pair of electrodes arranged in the discharge space, and wherein the dispenser means is provided on one of the neck-shaped portions in contact with one of the current-supply conductors. The physical contact between the dispenser means applied on the neck-shaped portion and the current-supply conductor is employed to guide heat from the current-supply conductor to the dispenser means. Preferably, the dispenser means is applied as a paste on the neck-shaped portion.

These and other aspects of the invention will be apparent from and elucidated with reference to the embodiments described hereinafter.

In the drawings.

The Figures are purely diagrammatic and not drawn to scale. Particularly for clarity, some dimensions are strongly exaggerated. Similar components in the Figures are denoted by as much the same reference numerals as possible.

Figure 1:
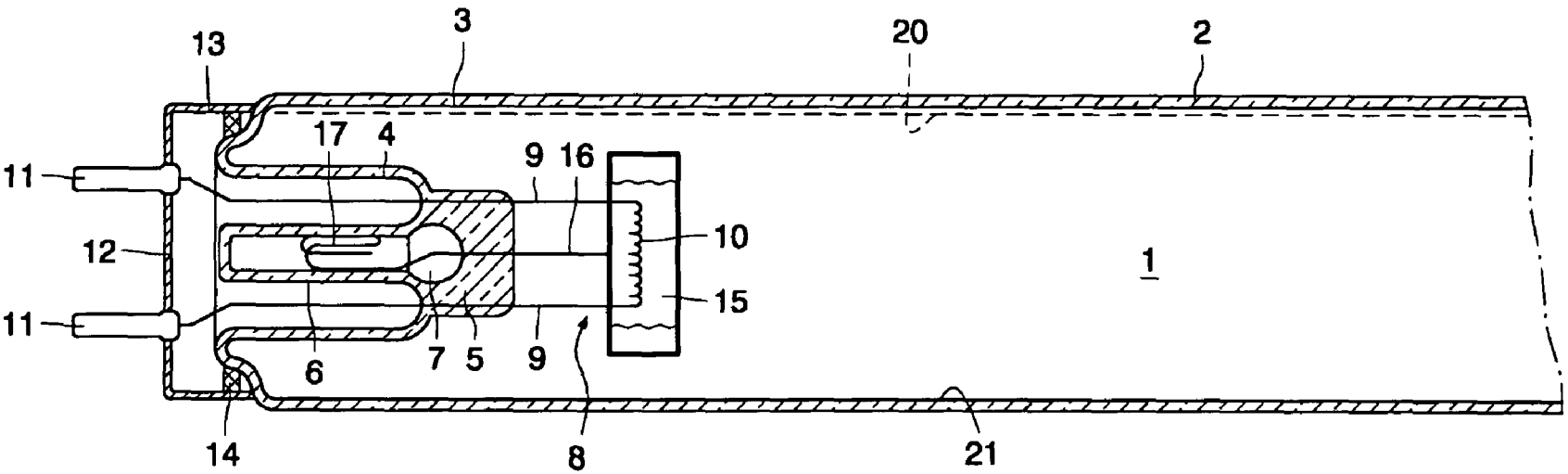
FIG. 1 is a partial cross-sectional view of a low-pressure mercury vapor discharge lamp according to an embodiment of the invention.

FIG. 1 shows a low-pressure mercury vapor discharge lamp comprising a light-transmitting discharge vessel 2 in the form of a tube. The figure only shows an end portion 3 of the discharge lamp, the actual discharge lamp comprising two opposing, identical end portions 3, which each close one side of a long glass discharge vessel 2. The discharge vessel 2 encloses, in a gastight manner, a discharge space 1 provided with a filling of mercury and a rare gas. Present on the inside of the discharge vessel 2 is a layer of a fluorescent material (not shown in FIG. 1), which is capable of converting UV light into UV-A light, UV-B light and/or visible light. In an alternative embodiment there is no fluorescent layer. In a further alternative embodiment the low-pressure mercury vapor discharge lamp comprises a compact fluorescent lamp (not shown). The tubular discharge vessel of so-called compact fluorescent lamps generally comprises a collection of relatively short straight parts having a relatively small diameter, which straight parts are connected together by means of bridge parts or arc-shaped parts. Compact fluorescent lamps are usually provided with an (integrated) lamp cap.

The discharge vessel 2 comprises an inwardly extending cylindrical neck-shaped portion 4 at its end, on which a stem 5 (also called "pinch") is mounted after two current supply conductors 9 and a support wire 16 have been melted therein. An outwardly extending, tubular exhaust tube 6 is mounted on the stem 5, which tube is in open communication with the contents of discharge vessel 2 via a hole 7 in the stem 5. Before final assembly of the discharge lamp takes place, a vacuum is generated in the discharge vessel 2 by an exhaust tube 6, which will have an even greater length than illustrated in FIG. 1, and the discharge vessel 2 is filled with the desired (inert) gas mixture. Furthermore, an amount of mercury is introduced into the lamp. Following that, the exhaust tube 6 is heated, causing the glass to soften, be squeezed shut and sealed off, so that the discharge vessel 2 is sealed airtight.

The low-pressure mercury vapor discharge lamp furthermore comprises discharge means 8 for maintaining a discharge in the discharge space 1. In the example of FIG. 1, the discharge means comprise an electrode 10 on either side carried by the current-supply conductors 9. The electrode comprises a tungsten coil coated with a film of an emitter material (containing, for instance oxides of barium, strontium, calcium and/or other oxides), which functions to stimulate the emission of electrons. The current-supply conductors 9 are held in position by the stem 5 (also see FIG. 2), in which the wires are melted near the sides thereof, which wires are furthermore connected to plug pins 11. Plug pins II are held in position in an electrically insulating disc 12, which forms part of a metal end cap 13. End cap 13 is fixed to the glass discharge vessel by means of an annular film of glue 14.

Plug pins 11 can be inserted into a lamp fitting, which supplies the low-pressure mercury vapor discharge lamp with an electric current. The resulting discharge between the discharge means 8 causes the mercury vapor molecules to ionize and to emit UV light, which is converted into light having the desired wavelength(s) by the fluorescent film on the inside wall of discharge vessel 2.

Figure 2:
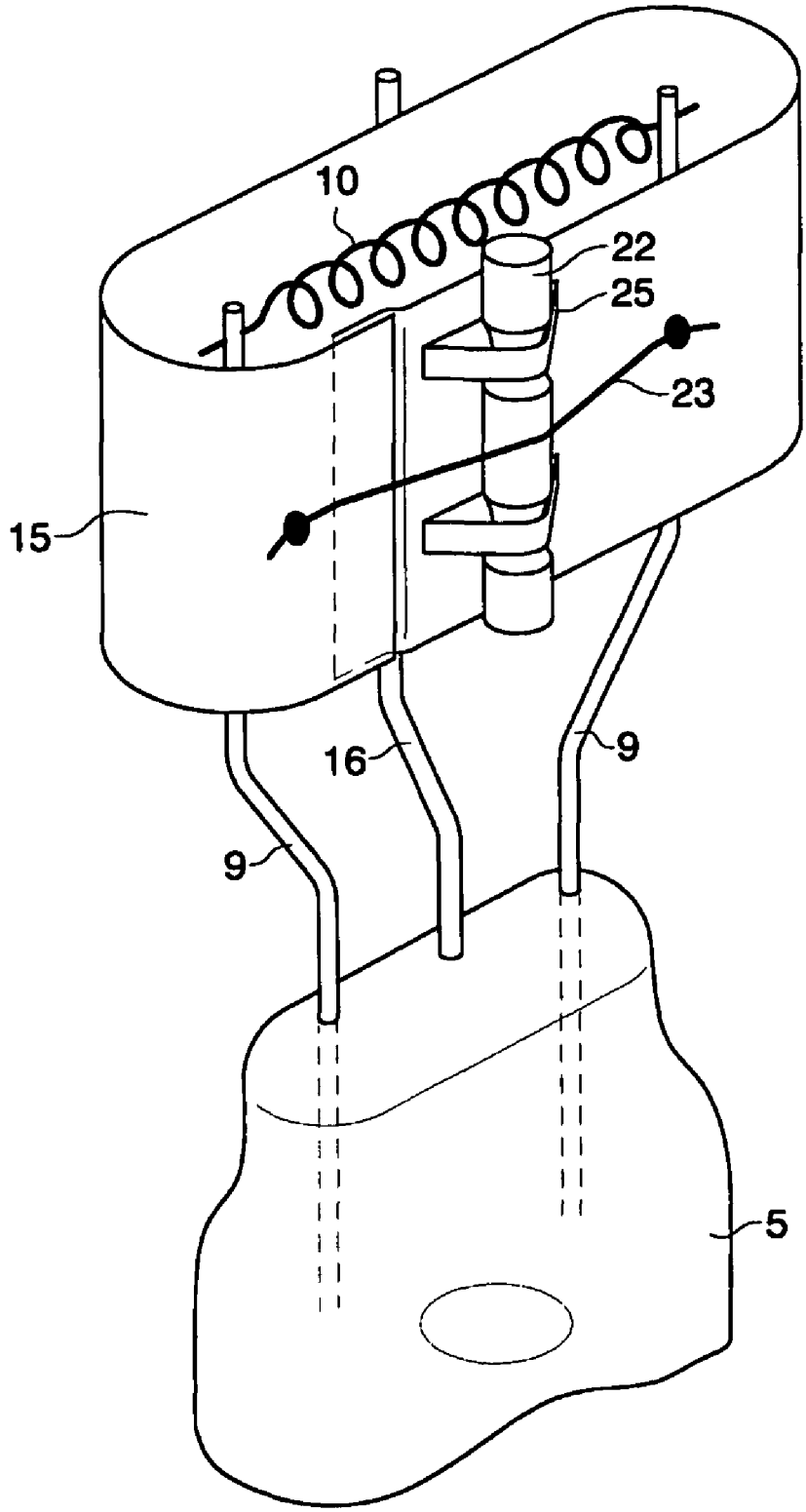
FIG. 2 is a perspective view of a detail of the low-pressure mercury vapor discharge lamp of FIG. 1 according to a further embodiment of the invention.

In order to prevent material that is discharged by the coil, as a result of the discharge that is maintained between the electrodes in use, from landing sideways on the inside wall of the discharge vessel 2, thus preventing a uniform light output along the length of the discharge vessel 2, the electrode 10 may be surrounded by a so-called electrode ring 15 (also see FIG. 2). The electrode ring 15 is made of a strip of metal, which has been bent into an at least substantially closed circumference approximately having an oval shape (also see FIG. 2). In FIG. 1, the electrode ring 15 is partially cut away so as to show the electrode 10. The electrode ring 15 is held in position by a wire-like, bent metal support wire 16 (also see FIG. 2), which is melted in the stem 5, just like the current-supply conductors 9, albeit in the central portion thereof. The support wire 16 can for example be made of iron, nickel, iron/nickel, chromium/nickel or molybdenum. If the anode electrode is dispensed with, the mercury can be dosed in the discharge vessel via a glass capsule in the pinch of the discharge vessel.

According to the invention, the discharge vessel 2 comprises a dispenser means 20 for controllably dispensing hydrogen into the discharge space 1. In the example of FIG. 1, the dispenser means 20 is applied to a part of an inner wall 21 of the discharge vessel 2.

FIG. 2 is a perspective view of a detail of the low-pressure mercury vapor discharge lamp of FIG. 1 according to an embodiment of the invention, wherein like parts are indicated by like numerals. Making available the dispenser means to the discharge space 1 is best done once the discharge vessel is hermetically sealed. To this end, the dispenser means (not shown in FIG. 2) are introduced in a closed capsule means 22 into the discharge space 1 during manufacturing of the discharge vessel 2. The glass capsule means 22 is clamped on the electrode ring 15 by means of clamping means 25. A metal wire 23 which was tightened on the glass capsule means 22 was heated, for example in a high-frequency electromagnetic field, during which the capsule means 22 was cut through and contact between the dispenser means and the discharge space 1 was established. In an alternative embodiment the wire 23 is activated by the induction of a current originating from a coil external to the discharge vessel 2. In an alternative embodiment, the metal wire 23 also acts as clamping means.

According to an embodiment of the invention the capsule means 22 in the discharge vessel 2 comprises the dispenser means for controllably dispensing hydrogen into the discharge space 1. The capsule means 22 are sealed off when the discharge vessel 2 is manufactured to ensure that the Ti—$H_2$ is enclosed in the capsule until lamp manufacturing is finished. Once the discharge vessel 2 is hermetically sealed, an opening is provided in the capsule means 22, or alternatively the capsule means 22 is cut open, thereby establishing contact between the dispenser means and the discharge space 1. The capsule means 22 provide a convenient manner of dosing the dispenser means into the discharge space 1. The presence of relatively small amounts of hydrogen during the life span of the low-pressure mercury vapor discharge lamp, surprisingly, leads to a significant reduction of the amount of mercury that is bound by parts of the lamp in the discharge vessel 2, so that an improved light output is realized in an elegant manner without further measures being required that burden the environment. According to the invention, the hydrogen gas pressure in the discharge vessel 2 is in the range between $10^{-3}$ Pa and 10 Pa. Preferably, the hydrogen gas pressure is in the range between $10^{-2}$ Pa and 1 Pa. Preferably, the hydrogen gas pressure is measured when the low-pressure mercury vapor discharge lamp is turned off for at least ten hours.

In an alternative embodiment of the low-pressure mercury vapor discharge lamp, the discharge vessel comprises a further neck-shaped portion, at least one support wire being arranged in the further neck-shaped portion and extending in the discharge space, and wherein the dispenser means is provided on a supporting means carried by the least one support wire. This is in particular the case in compact fluorescent lamps comprising a collection of relatively short straight parts having a relatively small diameter, which straight parts are connected together by means of so-called bridge parts or so-called arc-shaped parts. The further neck-shaped portion provided with a supporting means for carrying the dispenser means is arranged in one of the "dummy" legs of the compact fluorescent lamp. Many other embodiments are known to the person skilled in the art.

Preferably, the dispenser means 20 comprises a hydrogen-containing metal alloy like zirconium or a zirconium based alloy, while also Y, Ti and Hf based materials have similar properties. In an alternative embodiment, the dispenser means 20 comprises a metal hydride selected from the group consisting of titanium, zirconium, hafnium, a titanium-zirconium compound, a titanium-hafnium compound and a zirconium-hafnium compound. Particularly suitable is Ti—$H_2$ (titanium hydride) in the form of a (pressed) powder or paste in the capsule means 22. Other materials which are suitable for accumulating hydrogen and that can controllably release hydrogen are ZrCo, ZrNi, $ZrCo_{1-x}Ni_x$, or a ternary Zr—V—Fe alloy and also $LaNi_5$ and La $Ni_{5-x}Al_x$. In a further alternative embodiment, hydrogen gas is dosed in the discharge vessel. Suitable materials for accumulating hydrogen are based on Zr, Y, Ti, Hf, Ni, V, Fe, Co, La or on binary and ternary combinations thereof. In particular, a very suitable alloy is the ternary Zr (46.5% by weight)—V (36.4% by weight)—Fe (17.1% by weight) alloy. Experiments have shown that the hydrogen gas pressures in the range between $10^{-3}$ Pa ($=10^{-5}$ mbar) and 10 Pa ($=10^{-1}$ mbar) constitute equilibrium limits, within which the metal hydride containing materials have a satisfactory effect.

Figure 3:
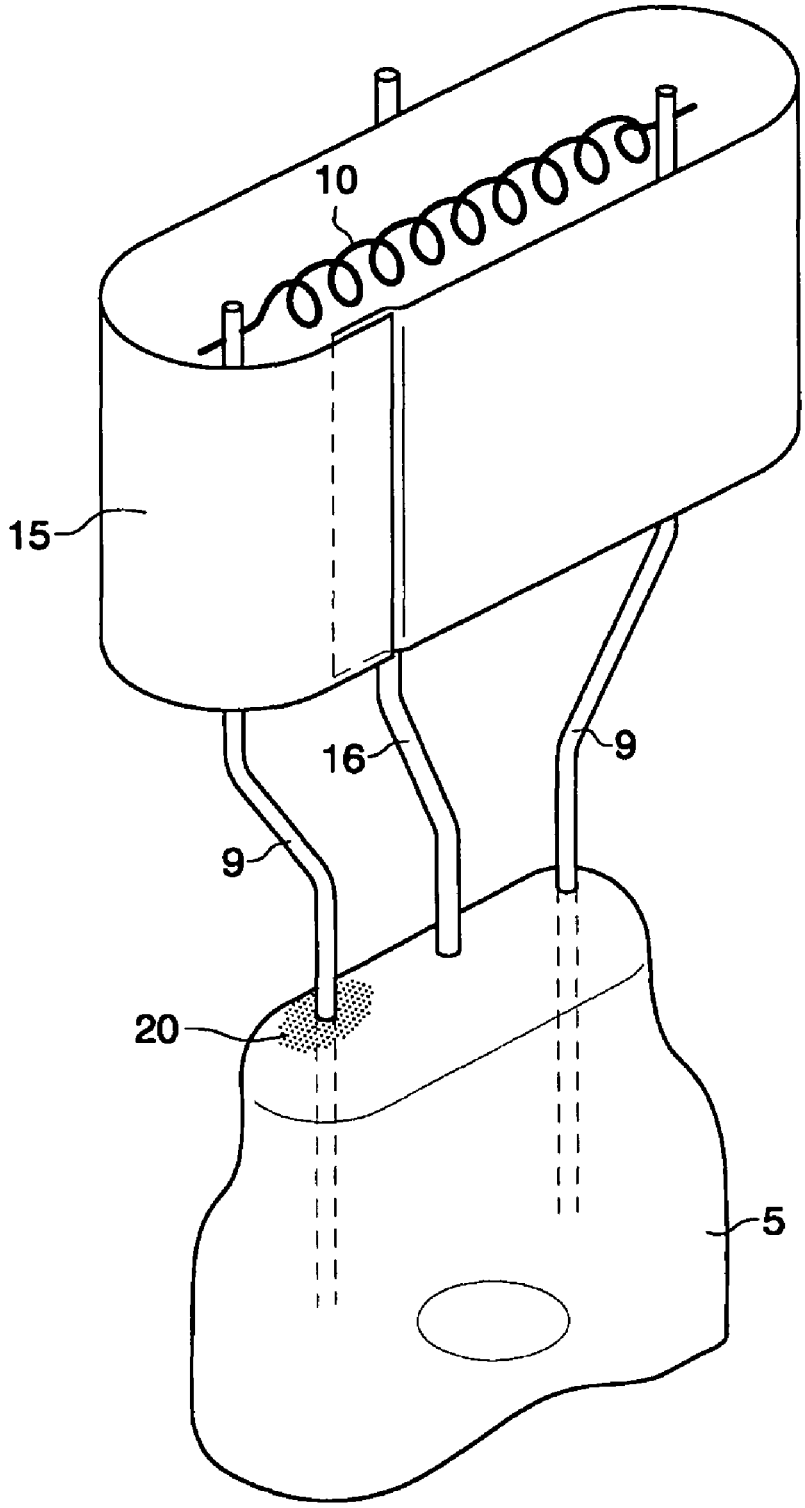
FIG. 3 is a perspective view of a detail of the low-pressure mercury vapor discharge lamp of FIG. 1 according to yet a further embodiment of the invention.

FIG. 3 is a perspective view of a detail of the low-pressure mercury vapor discharge lamp of FIG. 1 according to a further embodiment of the invention. In the example of FIG. 3 the dispenser means 20 is applied as a paste on the stem 5 of the neck-shaped portions 4 (see FIG. 1) in contact with one of the current-supply conductors 9. By promoting physical contact between the dispenser means 20 applied on stem 5 of the neck-shaped portion 4 and the current-supply conductor 9 heat is guided from the current-supply conductor 9 to the dispenser means 20. In an alternative embodiment, an additional paste is applied around the other current-supply conductor 9.

Figure 4:
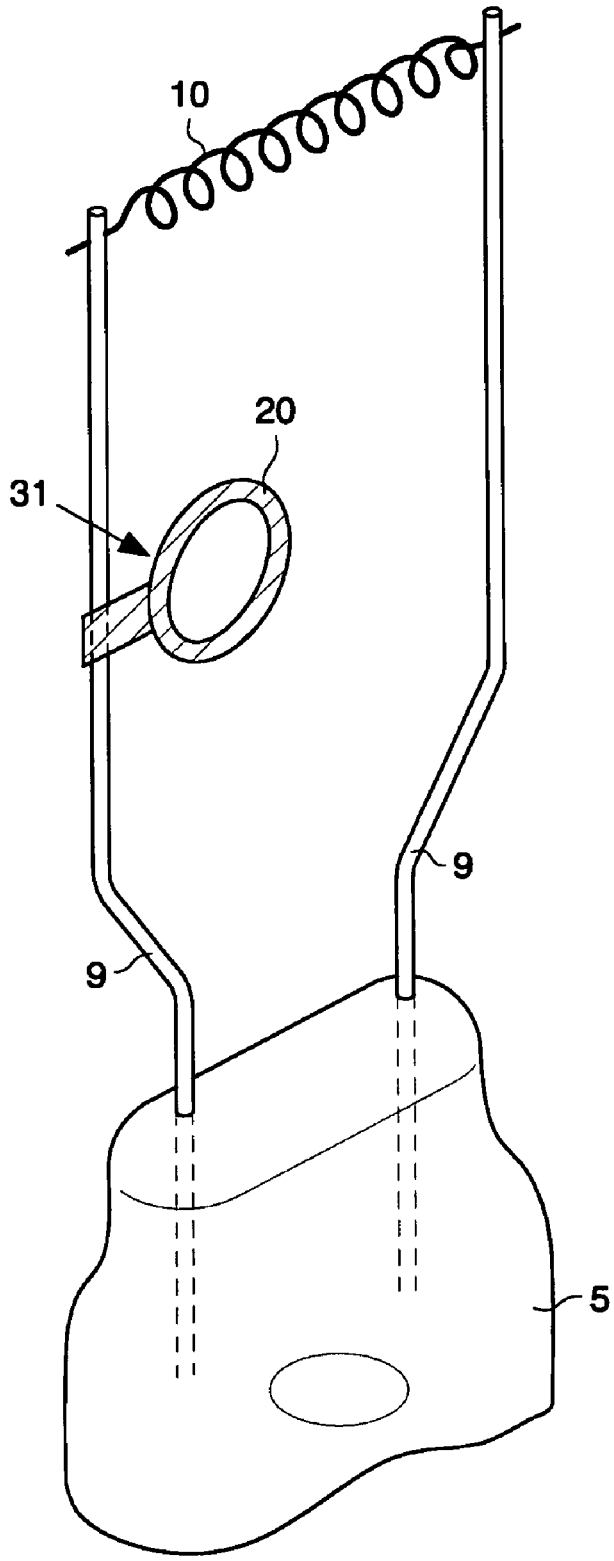
FIG. 4 is a perspective view of a detail of the low-pressure mercury vapor discharge lamp of FIG. 1 according to yet a further embodiment of the invention.

FIG. 4 is a perspective view of a detail of the low-pressure mercury vapor discharge lamp of FIG. 1 according to yet a further embodiment of the invention. In the example of FIG. 4, the dispenser means 20 is provided on a supporting means 31 carried by one of the current-supply conductors 9. In the example of FIG. 4, the supporting means 31 is an annular shaped body. Preferably, the supporting means 31 is electrically insulated from the current-supply conductor 9. Preferably, the supporting means 31 is made of an electrically conducting material, for example a metal. In an alternative embodiment a cup-shaped body is employed to support the dispenser means.

Figure 5:
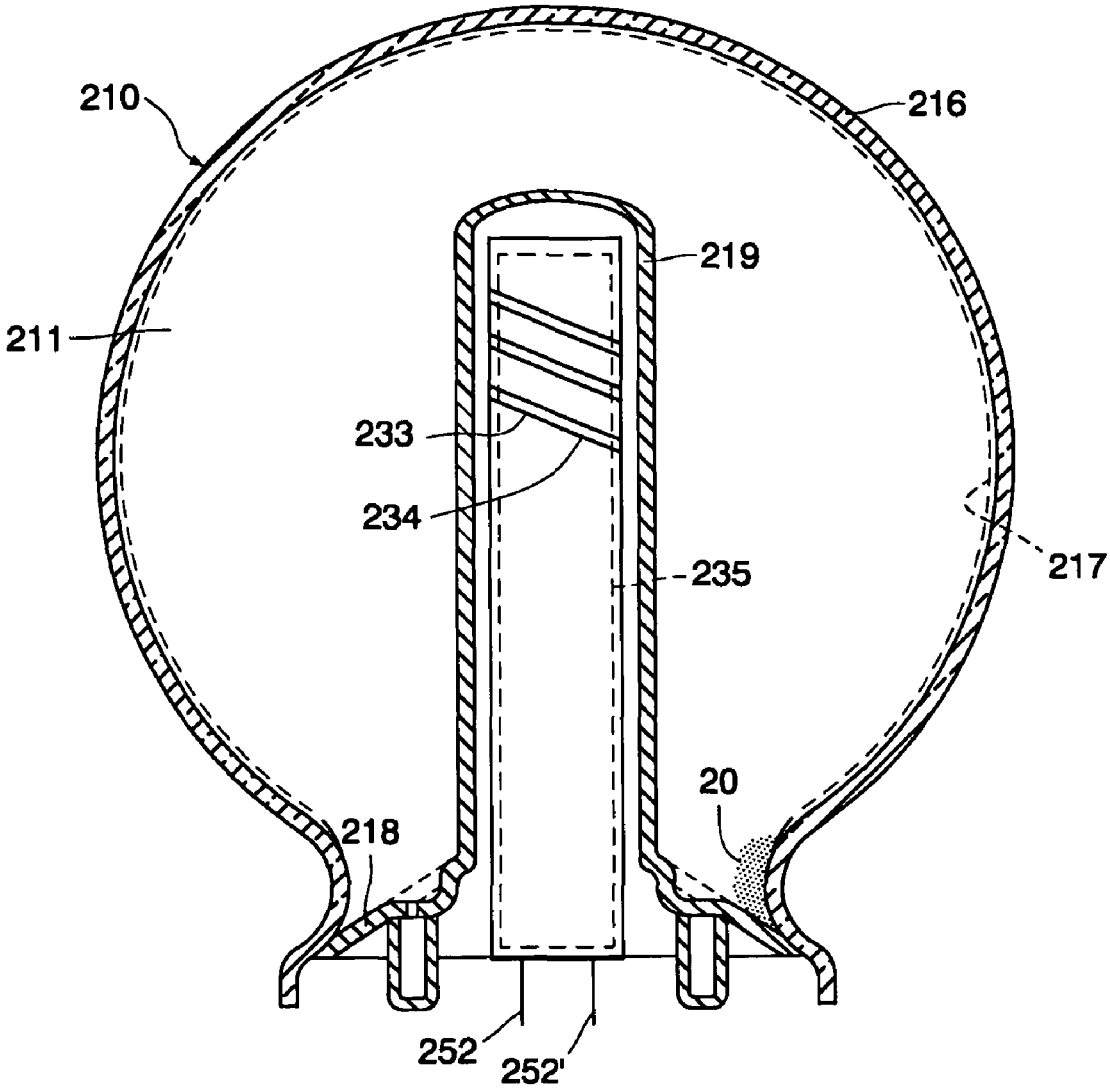
FIG. 5 is a perspective view of a detail of the electrodeless low-pressure mercury vapor discharge lamp.

FIG. 5 is a perspective view of a detail of a so-called electrodeless low-pressure mercury vapor discharge lamp. The discharge vessel 210 of the electrodeless low-pressure mercury vapor discharge lamp has a pear-shaped enveloping portion 216 and a tubular invaginated portion 219 that is connected to the enveloping portion 216 via a flared portion 218. The invaginated portion 219, outside a discharge space 211 surrounded by the discharge vessel 210, accommodates a coil 233 which has a winding 234 of an electric conductor constituting means for maintaining an electric discharge in the discharge space 211. The coil 233 is fed via current supply conductors 252, 252' with a high-frequency voltage during operation, i.e. a frequency of more than approximately 20 kHz, for example approximately 3 MHz. The coil 233 surrounds a core 235 of a soft-magnetic material (shown in broken lines). Alternatively, a core may be absent. In an alternative embodiment, the coil is arranged, for example, in the discharge space 211. The dispenser means 20 are provided on the base of the pear-shaped enveloping portion 216 or on the top of the invaginated portion 219.

Figure 6:
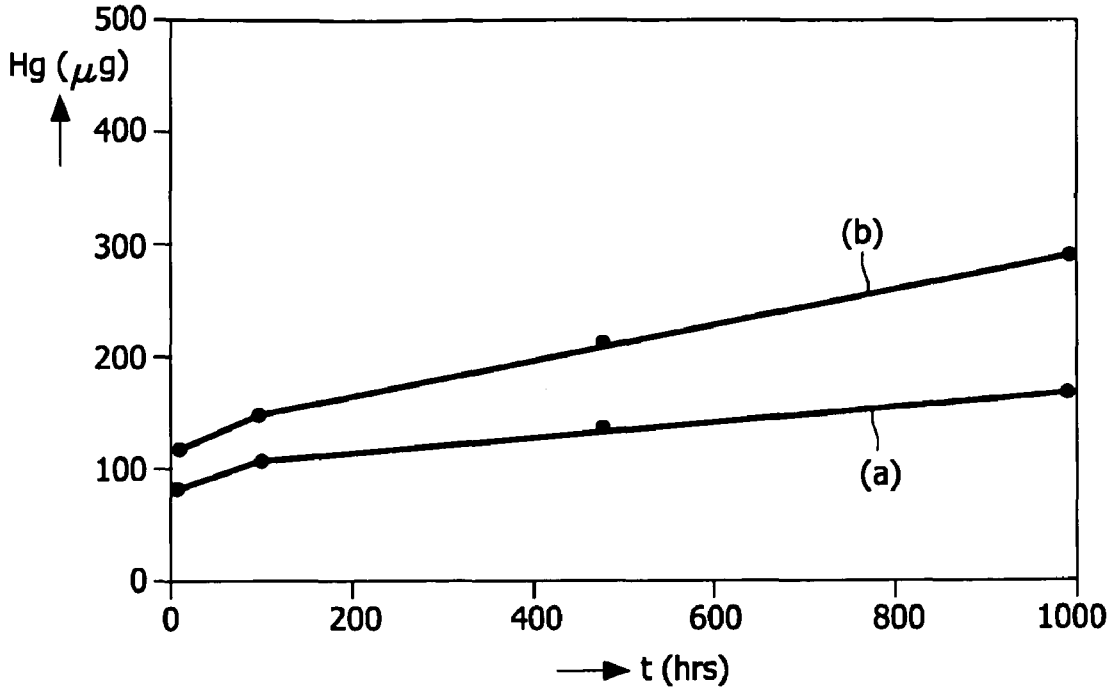
FIG. 6 is a graph of the mercury consumption of a low-pressure mercury vapor discharge lamp according to the invention as compared to a known low-pressure mercury vapor discharge lamp.

FIG. 6 shows a graph of the mercury consumption (μg) as a function of time (hours) of a low-pressure mercury vapor discharge lamp according to the invention (curve a) as compared to a known low-pressure mercury vapor discharge lamp (curve b). It can be seen that the mercury consumption is significantly reduced in the low-pressure mercury vapor discharge lamp with the dispenser means for controllably dispensing hydrogen into the discharge space as compared to the known discharge lamp.

Figure 7:
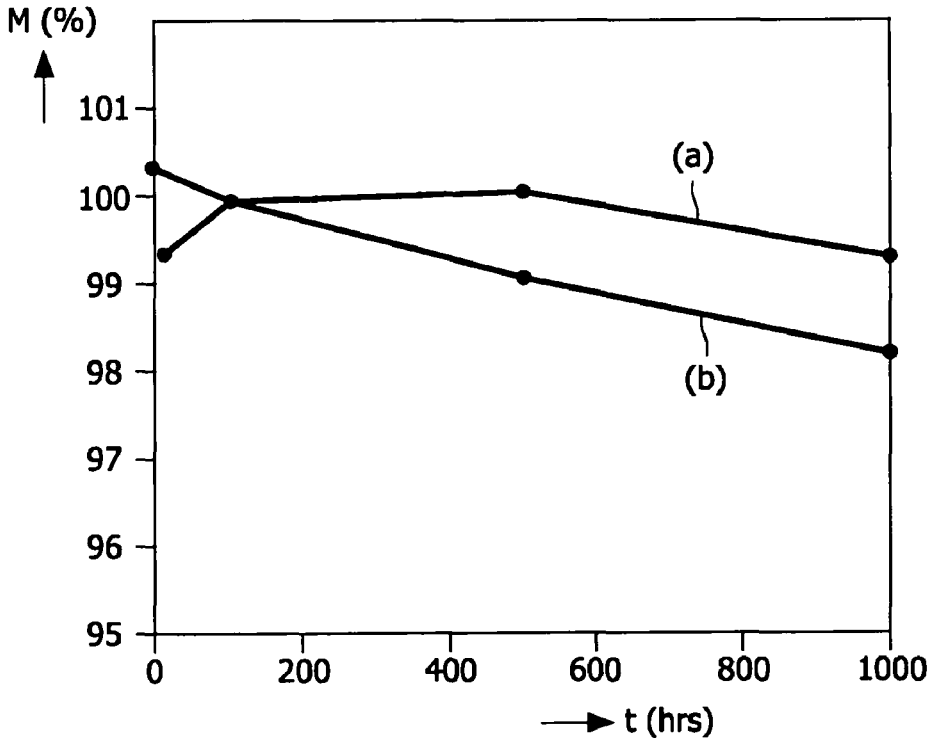
FIG. 7 is a graph of the maintenance of a low-pressure mercury vapor discharge lamp according to the invention as compared to a known low-pressure mercury vapor discharge lamp.

FIG. 7 is a graph of the maintenance (%) as a function of time (hours) of a low-pressure mercury vapor discharge lamp according to the invention (curve a) as compared to a known low-pressure mercury vapor discharge lamp (curve b). As usual, the graphs are drawn relative to the maintenance of the discharge lamp at 100 hrs. It can be seen that the maintenance has significantly improved in the low-pressure mercury vapor discharge lamp with the dispenser means for controllably dispensing hydrogen into the discharge space as compared to the known discharge lamp.

It should be noted that the above-mentioned embodiments illustrate rather than limit the invention, and that those skilled in the art will be able to design many alternative embodiments without departing from the scope of the appended claims. In the claims, any reference signs placed in parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A low-pressure mercury vapor discharge lamp comprising a light-transmitting discharge vessel, the discharge vessel enclosing, in a gastight manner, a discharge space provided with a filling of mercury and a rare gas, the discharge vessel comprising:

at least one electrode for maintaining a discharge in the discharge space; and a dispenser for controllably dispensing hydrogen into the discharge space;

wherein hydrogen gas pressure in the discharge vessel, measured when the low-pressure mercury vapor discharge lamp is turned off for at least ten hours, is greater than $10^{-1}$ Pa and less than 7 Pa.

2. The low-pressure mercury vapor discharge lamp according to claim 1, wherein the hydrogen gas pressure is in the range between $10^{-1}$ Pa and 1 Pa.

3. The low-pressure mercury vapor discharge lamp according to claim 1, wherein the dispenser comprises a hydrogen-containing metal or metal alloy.

4. The low-pressure mercury vapor discharge lamp according to claim 3, wherein the hydrogen-containing metal or metal alloy is selected from the group formed by zirconium, yttrium, titanium, lanthanum and hafnium.

5. The low-pressure mercury vapor discharge lamp according to claim 1, wherein the dispenser comprises a metal hydride selected from the group consisting of titanium, zirconium, hafnium, a titanium-zirconium compound, a titanium-hafnium compound and a zirconium-hafnium compound.

6. The low-pressure mercury vapor discharge lamp according to claim 3, wherein the metal alloy is a ternary Zr—V—Fe alloy.

7. The low-pressure mercury vapor discharge lamp according to claim 6, wherein the ternary alloy is a Zr (46.5% by weight)—V (36.4% by weight)—Fe (17.1% by weight) alloy.

8. The low-pressure mercury vapor discharge lamp according to claim 1, wherein the dispenser is provided on an inner wall of the discharge vessel.

9. The low-pressure mercury vapor discharge lamp according to claim 1, wherein the dispenser comprises a capsule arranged in the discharge vessel.

10. The low-pressure mercury vapor discharge lamp according to claim 1, wherein the discharge vessel comprises mutually opposed neck shaped portions, current-supply conductors arranged in each of the neck-shaped portions extending to a pair of electrodes arranged in the discharge space, and wherein the dispenser is provided on a supporting member carried by one of the current-supply conductors.

11. The low-pressure mercury vapor discharge lamp according to claim 10, wherein the supporting member comprises an annular shaped body.

12. The low-pressure mercury vapor discharge lamp according to claim 1, wherein the discharge vessel comprises mutually opposed neck shaped portions, current-supply conductors arranged in each of the neck-shaped portions extending to a pair of electrodes arranged in the discharge space, and wherein the dispenser is provided on one of the neck-shaped portions in contact with one of the current-supply conductors.

13. The low-pressure mercury vapor discharge lamp of claim 1, wherein the dispenser comprises a paste on a stem of a neck-shaped portion in contact with a current-supply conductor extending through the stem.

* * * * *